United States Patent [19]

Lubbock et al.

[11] Patent Number: 4,911,039

[45] Date of Patent: Mar. 27, 1990

[54] ELECTRIC EXTENSION POLE

[75] Inventors: Clyde G. Lubbock, Fairfield; James B. Muir, Vallejo, both of Calif.

[73] Assignee: Sol-Plex, Suisun City, Calif.

[21] Appl. No.: 391,677

[22] Filed: Aug. 8, 1989

Related U.S. Application Data

[63] Continuation of Ser. No. 260,097, Oct. 20, 1988, abandoned.

[51] Int. Cl.[4] ..... B25B 23/16

[52] U.S. Cl. ..... 81/53.1; 16/115; 294/19.1

[58] Field of Search ..... 81/53.1, 53.11, 53.12, 81/54, 177.75, 177.2, 484, 488, 57.42–57.45; 16/115; 294/19.1

[56] References Cited

U.S. PATENT DOCUMENTS

| | | | |
|---|---|---|---|
| 1,345,027 | 6/1920 | Rippe | 81/484 |
| 4,078,589 | 3/1978 | Miller . | |
| 4,385,849 | 5/1983 | Craw | 81/53.1 |
| 4,400,028 | 8/1983 | Conrad | 294/19.1 |
| 4,521,993 | 6/1985 | Tacheny et al. . | |
| 4,715,089 | 12/1987 | Schema | 16/115 |
| 4,793,646 | 12/1988 | Michaud | 294/19.1 |

*Primary Examiner*—James G. Smith

*Attorney, Agent, or Firm*—Townsend and Townsend

[57] ABSTRACT

A motorized extension pole for opening and closing a skylight. The extension pole includes an elongated member having first and second telescoping sections for adjusting the overall effective length of the elongated member. A manipulating element is mounted at one end of the elongated member. A power source is located at the opposite end within a handle. The manipulating member cooperates with a conventional window operator. The power source is operated by a switch selectively actuated to rotate the elongated member and manipulating member in a direction for either opening or closing the skylight. A spindle grip is mounted about the elongated member for steadying the pole with both hands.

4 Claims, 1 Drawing Sheet

ELECTRIC EXTENSION POLE

This is a continuation of application Ser. No. 260,097, filed Oct. 20, 1988, now abandoned.

BACKGROUND OF THE INVENTION

1. Field of the Invention

This invention relates to an extension pole for opening and closing a skylight.

Skylights are often difficult to reach and, therefore, opening can be troublesome. Typically, a skylight capable of being opened includes a chain-driven window operator manipulated by the end of a crank pole. The end of the pole is configured to grasp and rotate the window operator. The opposite end of the pole includes a crank for rotating the pole with the operator and, thereby, opening the skylight. The user must support the pole in its upright position, maintaining cooperation between the manipulating end of the pole and operator, while, at the same time, cranking the opposite end of the pole.

2. Description of the Prior Art

U.S. Pat. No. 4,715,089 to Schema discloses a pole assembly for opening skylights. The pole includes two telescoping members which can be adjusted to differing effective lengths. To operate, one must manually crank an end of the pole. The purpose of the Schema device is to allow infinite adjustment in the effective length.

U.S. Pat. No. 4,521,993 to Tacheny et al. discloses a motor driven module for opening skylight windows. Rather than employing a pole for opening the skylight, the device of Tacheny et al. is mounted directly to the skylight and operated by a switch wired within easy reach of the user. This device may be premounted to the skylight or may be retrofitted for existing skylights.

U.S. Pat. No. 4,078,589 to Miller discloses a pole. battery operated screwdriver. In the field of construction, long threaded bolts are often employed. The purpose of the Miller patent is to enable a worker to tighten the bolts quickly. The screwdriver is light in weight and may be used at inaccessible locations. If a high torque is required to rotate a bolt, for example one that is stuck or frozen, the shaft is locked and the device may be rotated manually.

SUMMARY OF THE INVENTION

The present invention is a pole for opening a skylight which is extendable and electrically activated. The pole includes an elongated member having a manipulating element attached at one end and a motor-driven power source attached at its opposite end.

The elongated member includes a first and a second section. The first section is fully retractable within the second section. The effective length of the elongated member may be adjusted by partially retracting the first section into the second section. A detent cooperates with the first and second sections for retaining the relative positioning and maintaining the effective length of the elongated member.

A mounting is positioned at one end of the first section for supporting the manipulating element. In its fully retracted position, the mounting is prevented from retracting within the second section because the diameter of the mounting is larger than the inner diameter of the second section.

The motor-driven power source is positioned at the end of the elongated member opposite the manipulating element. The power source is actuated by an operating switch for selectively rotating the elongated member in order to either open or close the skylight. The power source rotates the elongated member at a slow and steady speed to allow the user to maintain control of the pole. Additionally, the slow rotating speed enables the user to obtain the desired ventilation afforded by the window opening. A single switch is employed for rotating the elongated member in both the forward and reverse directions. Thus, the pole remains simple and easy to use with fewer control elements.

A spindle grip is mounted on the elongated member near the end of the pole at which the power source is attached. The spindle grip rotates relative to the elongated member.

In the preferred embodiment, the manipulating element, mounting, first and second sections, spindle grip and power source are coaxial. This results in a pole which is easy to manipulate and control.

DETAILED DESCRIPTION OF THE PREFERRED EMBODIMENT

Figures 1, 2:
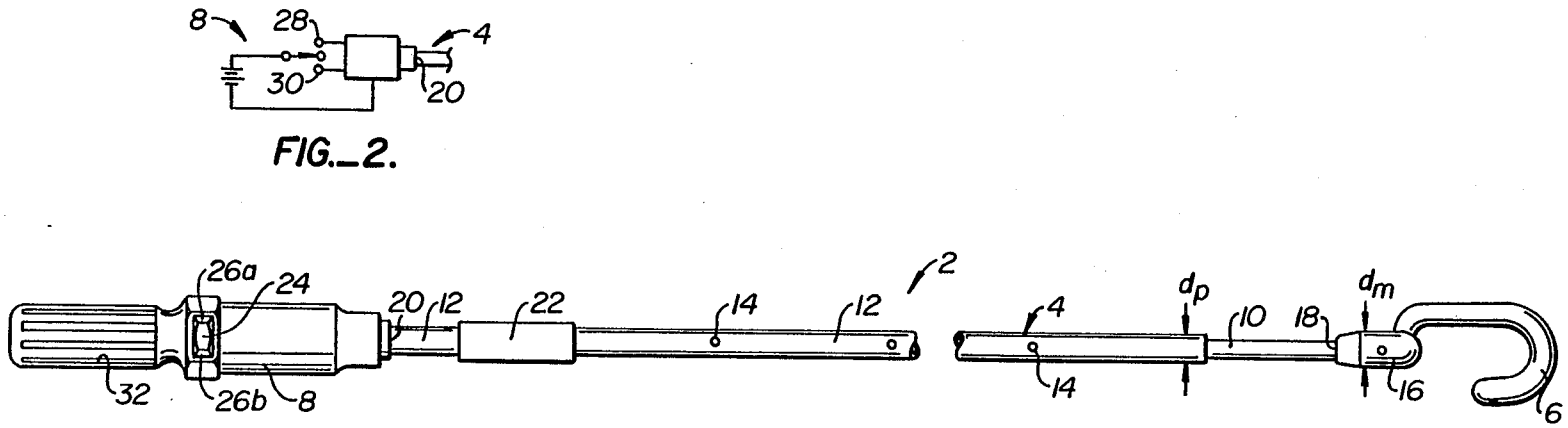
FIG. 1 is a side view of the present invention.
FIG. 2 is a schematic view of the power source of the present invention.

An extension pole 2 includes an elongated member 4 having a manipulating element 6 at one end 18 and a power source 8 positioned within handle 32 at the opposite end 20 of elongated member 4.

Elongated member 4 includes a first section 10 and a hollow second section 12. First section 10 is telescopically movable within hollow second section 12 to selectively adjust the overall effective length of elongated member 4. A detent 14 retains first section 10 and second section 12 in their desired relative positions. Detents 14 may include a hole formed in one of the first and second sections 10, 12 and a snap fit connection formed in the other section. Alternatively, the detent may include a spring and ball attachment.

A mounting 16 is attached to one end 18 of first section 10. Mounting 16 has a diameter $D_m$ greater than the diameter $D_p$ of second section 12, the purpose of which will be described below. Manipulating element 6 is supported on mounting 16 for operating a window operator (not shown). The manipulating element 6 may be in the form of a hook as seen in FIG. 1, or a ball and socket connection (not shown) to match a conventional window operator.

A spindle grip 22 is mounted encircling second section 12 adjacent end 20 of second section 12. Spindle grip 22 is mounted on bearings (not shown). Handle 32 is positioned at end 20 of second section 12.

Power source 8 is mounted to extension pole 2 within handle 32. Power source 8 is actuated by an operating switch 24. A schematic of the power source is shown in FIG. 2 of the drawings. FIG. 2 shows switch 24 in its at rest position. Switch 24 is depressed on either side **26*a*, 26*b* to rotate elongated member 4 in either the clockwise or counterclockwise direction. In its at rest position, switch 24 is in the position as seen in FIG. 2. As seen in FIG. 1 in its at rest position, the surface of operating switch 24 is substantially parallel to the axis about which manipulating element 6, elongated member 4, handle 32 and power source 8 are aligned. As switch 24 is depressed at either side 26*a*, 26*b*, the electrical circuit will be moved to either reverse position 28 or forward position 30**.

Manipulating element 6, mounting 16, elongated member 4, including first section 10 and second section 12, spindle grip 22 and power source 8 are coaxially aligned. Thus, manipulation and control of the extension pole is enhanced.

In use, the length of elongated member 4 is adjusted to facilitate manipulation of the window operator (not shown). First section 10 is telescopically movable from the interior of hollow second section 12. When elongated member 4 is extended to its desired length, it is retained in place by detents 14.

Manipulating element 6 is linked to the window operator. Once manipulating element 6 is attached to the window operator, the user's thumb depresses a side 26 of switch 24 for rotating elongated member 4 in either the forward or reverse directions. The user holds extension pole 2 by handle 32 so that the thumb may depress side 26*a* or 26*b* to operate switch 24. The other hand is placed on spindle grip 22 for steadying the pole. In this way, it is possible to use both hands, easing manipulation and control of extension pole 2. As handle 32 and spindle grip 22 are held and switch 24 depressed, elongated member 4 along with mounting 16 and manipulating element 6 rotate to either open or close the skylight. Spindle grip 22 rotates on bearings (not shown). As the user depresses switch 24 on its side 26, the circuit is completed as seen as forward position 30 in FIG. 2 to open the skylight. As switch 24 is depressed on the opposite side 26, the circuit is completed as seen as reverse position 28 so that elongated member 4 rotates in the opposite direction to close the skylight.

Once the skylight is opened (or closed) to the desired ventilating aperture, manipulating element 6 is disconnected from the window operator. First section 10 is then fully retracted into second section 12 to its storage position. In this position, only mounting 16 and manipulating element 6 extend from the hollow interior of second section 12. Diameter $D_m$ of mounting 16 being larger than diameter $D_p$, prevents interference between manipulating element 6 and elongated member 4. Extension pole 2 may be stored compactly while remaining fully assembled.

This invention has been described with reference to the preferred embodiment. Variations and modifications can be made without departing from the scope of the present invention, which is limited only by the following claims.

What is claimed is:

1. An extension pole for rotatably operating a skylight operator for opening a skylight to a desired position, the extension pole comprising:

an elongated member having a first end and a second end and an effective length, the elongated member including a first section and a second section, the first section being positioned within and telescopically movable with respect to the second section for changing the effective length of the elongated member;

a manipulating element mounted at the first end of the elongated member for manipulating the skylight operator to open and close the skylight;

a motor driven power source positioned at the second end of said elongated member and including an operating switch having a surface for actuating the power source, the power source for rotating the elongated member having means for selectively rotating said elongated member in one of a clockwise and a counterclockwise direction at a speed so as to maintain control of the pole and to obtain the desired position, thereby providing desired ventilation;

a handle position at the second end, and wherein the power source is contained within said handle;

a spindle grip mounted on the elongated member adjacent the end of the second section between said handle and said manipulating element;

wherein the handle and spindle grip remain stationary while the elongated member rotates;

wherein said manipulating element, said elongated member, said handle and said power source are substantially coaxially aligned; and wherein the surface of said operating switch is substantially parallel to the axis about which said manipulating element, said elongated member, said handle and said power source are substantially aligned.

2. The extension pole as defined by claim 1 further comprising a detent cooperating with the first and second sections for retaining the relative positioning of the first and second sections at a selected effective length.

3. The extension pole as defined by claim 1 further comprising a mounting positioned at said one end of the first section, said mounting having a diameter greater than a diameter of the second section and wherein the manipulating member is positioned on said mounting.

4. The extension pole as defined by claim 1 wherein the manipulating element comprises a hook.

* * * * *